US007416083B2

(12) United States Patent
Bando

(10) Patent No.: US 7,416,083 B2
(45) Date of Patent: Aug. 26, 2008

(54) CONTAINER FOR HOUSING WET SHEET PACKAGE

(75) Inventor: Takeshi Bando, Kagawa (JP)

(73) Assignee: Uni-Charm Corporation, Shikokuchuo-shi, Ehime-ken (JP)

( * ) Notice: Subject to any disclaimer, the term of this patent is extended or adjusted under 35 U.S.C. 154(b) by 387 days.

(21) Appl. No.: 11/115,746

(22) Filed: Apr. 27, 2005

(65) Prior Publication Data

US 2005/0258062 A1 Nov. 24, 2005

(30) Foreign Application Priority Data

May 18, 2004 (JP) ..... 2004-147392

(51) Int. Cl.
*B65D 73/00* (2006.01)
*A47K 10/24* (2006.01)

(52) U.S. Cl. ..... 206/494; 206/210; 206/233; 206/812; 221/46; 221/62

(58) Field of Classification Search ..... 206/233, 206/494, 210, 812; 221/45–48, 61–64
See application file for complete search history.

(56) References Cited

U.S. PATENT DOCUMENTS 2,826,230 A * 3/1958 Conell ..... 206/494
3,383,012 A * 5/1968 Adell ..... 221/46
3,784,055 A 1/1974 Anderson
3,967,756 A * 7/1976 Barish ..... 221/45
3,986,479 A * 10/1976 Bonk ..... 221/63
4,138,034 A * 2/1979 McCarthy ..... 221/48
4,185,754 A 1/1980 Julius
4,535,912 A * 8/1985 Bonk ..... 221/46
4,735,317 A * 4/1988 Sussman et al. ..... 206/494
5,145,091 A * 9/1992 Meyers ..... 221/45
5,996,797 A * 12/1999 Flaig ..... 206/494
6,092,690 A * 7/2000 Bitowft et al. ..... 206/494
6,431,360 B1 * 8/2002 Julius ..... 206/494
6,609,616 B2 * 8/2003 Dilnik et al. ..... 206/494
6,702,109 B1 * 3/2004 Tabuchi ..... 203/233
7,140,492 B2 * 11/2006 Julius ..... 206/494
2004/0035738 A1 2/2004 Julius

FOREIGN PATENT DOCUMENTS

JP 11-070056 3/1999
JP 11-292164 10/1999

* cited by examiner

*Primary Examiner*—Bryon P Gehman
(74) *Attorney, Agent, or Firm*—Darby & Darby P.C.

(57) ABSTRACT

A container for housing a package includes a case made of a flexible sheet. The package is adhered to a frame around a dispensing opening of the container through a pressure-sensitive adhesive layer. The frame has a lid. When the lid is opened, wet sheets can be taken out of the package. Since the frame is adhered to the package around the dispensing opening, a simple fastener can be used for keeping the case in an unopened state.

18 Claims, 4 Drawing Sheets

CONTAINER FOR HOUSING WET SHEET PACKAGE

BACKGROUND OF THE INVENTION

1. Field of the Invention

The present invention relates to a container for a package formed by housing wet sheets in a bag made of a flexible packaging material and more particularly to a container of which a case is flexible and allows the package to be easily put in and taken out and which is improved in the effect of keeping the wet sheets from drying out.

2. Description of the Related Art

Wet sheets to be used for cleansing the skin, for wiping the excretory parts of an infant when a diaper is changed or for wiping stains off the toilet bowl and the like are typically nonwoven fabrics impregnated with a chemical containing a cleansing ingredient. Wet sheets of this kind are usually supplied and sold in the form of a package formed by housing a number of wet sheets in a bag made of a flexible packaging material. This bag has a dispensing opening and a lid seal is adhered to the bag through a pressure-sensitive adhesive layer to cover the dispensing opening.

When taking out the wet sheets, the lid seal, which is peelably adhered to the bag, is peeled to expose the dispensing opening. However, since the lid seal should be peeled against an adhesion force due to the pressure-sensitive adhesive, a relatively large force is required to peel the lid seal, so that it is cumbersome to peel the lid seal over and over again.

After a few wet sheets are taken out, moreover, the lid seal should be adhered to the bag without leaving wrinkles so as to completely close the dispensing opening. If not, wet sheets left in the bag cannot be prevented completely from drying out. However, since the bag is made of a flexible packaging material, adhering the lid seal to the bag again is likely to make wrinkles in the packaging material or the lid seal. Thus, complete adhesion of the lid seal to the bag at a location around the dispensing opening is not easy to achieve.

On the other hand, containers have been developed for household use so as to house the packages therein. Such a container includes a rigid case made of a plastic material and a separable part for insertion of the package into the case. In addition, the container has an opening for facing the dispensing opening of the package housed therein, as well as a rigid lid movably mounted to open and close the opening.

The package is housed in the container with the lid seal removed to expose the dispensing opening. Opening the rigid lid enables removal of wet sheets out of the package, and after take out of wet sheets, the container can be sealed by closing the lid. The rigid lid of the container is easier to operate than the lid seal of the package.

However, such a rigid container, which is suitable for stationary use in the home, is not suitable for portable use outside the home.

In addition, when the package is housed in the container, a relatively large space is left between the outer surface of the package and the inner surface of the container and it communicates with the inside of the package through the dispensing opening. Since moisture contained in the wet sheets inside the package is allowed to evaporate into this space, the wet sheets are liable to dry out.

Japanese Unexamined Patent Publication No. H11-70056 discloses a lid body to be mounted on the bag of the package.

This lid body has an openable plate and is adhered to the bag of the package through a pressure-sensitive adhesive tape or the like to thereby cover the dispensing opening with the openable plate. In this invention, the dispensing opening of the package can be easily exposed and closed by operating the openable plate. In addition, since a single lid body can be used several times for different packages, this invention contributes to resource saving and reduction of waste generation.

However, the lid body, which is fixed on the bag through an adhesion force of the tape, is liable to fall off the package when an external force is exerted on the lid body during portable use. Particularly when a shearing force is exerted to slide the lid body on the package, the adhesion force alone cannot withstand the shearing force, so that the lid body is liable to fall off the package. If the lid body falls off the package during portable use outside the home, the dispensing opening of the package is left opened to let the wet sheets dry out.

SUMMARY OF THE INVENTION

The present invention has been developed in view of the shortcomings in the prior art set forth above. It is therefore an object of the present invention to provide a container which is lightweight, easy to carry around, and improved in the effect of keeping wet sheets from drying out.

According to the present invention, there is provided a container for a package formed by housing wet sheets in a bag which is made of a flexible packaging material and has a dispensing opening, the container comprising:

a case at least a part of which is made of a flexible sheet to define therein a storage space for housing the package, the case having a window for facing the dispensing opening of the package and an openable part which is allowed to be separated away from other parts of the case to form a storage opening for enabling storage of the package;

fixation means for keeping the openable part in an unopened position to close the storage opening;

a frame secured to the case all along a periphery of the window;

a lid for closing an opening defined by the frame and eventually closing the window; and close contact means for keeping an inner surface of the container in close contact with the bag around the dispensing opening.

In the present invention, since the container is at least partly flexible and lightweight, the container housing the wet sheet package is easy to carry around. When the lid is closed, moreover, the wet sheets inside the package can be effectively prevented from drying out, because the close contact means leaves only a small space, which permits evaporation of water in the wet sheets, between the container and the package. Furthermore, since the whole package is enclosed and supported by the container, close contact due to the close contact means can be easily maintained around the dispensing opening of the package.

In the present invention, the case may have a top part with the window and a bottom part on opposite side of the top part, and the openable part may include one of the top and bottom parts. If the top part or the bottom part is allowed to be separated away from other parts, it becomes easy to position the dispensing opening with respect to the window when the package is adhered to the container.

In one preferred embodiment, the fixation means is a hook-and-loop fastener for engaging confronting surfaces of the flexible sheet of the case. In another preferred embodiment, the fixation means is a zipper. In the present invention, since the container can be kept in close contact with the package around the dispensing opening through the close contact means, it is not required to seal the case with the fixation means. Thus, the hook-and-loop fastener or the zipper should be sufficient for the purpose of keeping the openable part in an unopened position. With such fixation means, the package can easily be put in and taken out of the container.

In the present invention, preferably, the close contact means enables the close contact all along the periphery of the window with the dispensing opening positioned within the window.

In one preferred embodiment, the close contact means is a pressure-sensitive adhesive layer. The pressure-sensitive adhesive layer may be disposed directly on an inner surface of the case, but it is preferred that the frame has an inner wall surface which is flat and located inside the case for facing the package and the pressure-sensitive adhesive layer is disposed on the inner wall surface. The flat inner wall surface facilitates close contact through the pressure-sensitive adhesive layer.

In another preferred embodiment, the container further comprises a fitting frame which is allowed to be mounted on the package around the dispensing opening and to be fitted to the frame secured to the case.

BRIEF DESCRIPTION OF THE DRAWINGS

The present invention will be understood more fully from the detailed description given hereinafter and from the accompanying drawings of the preferred embodiments of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiments according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
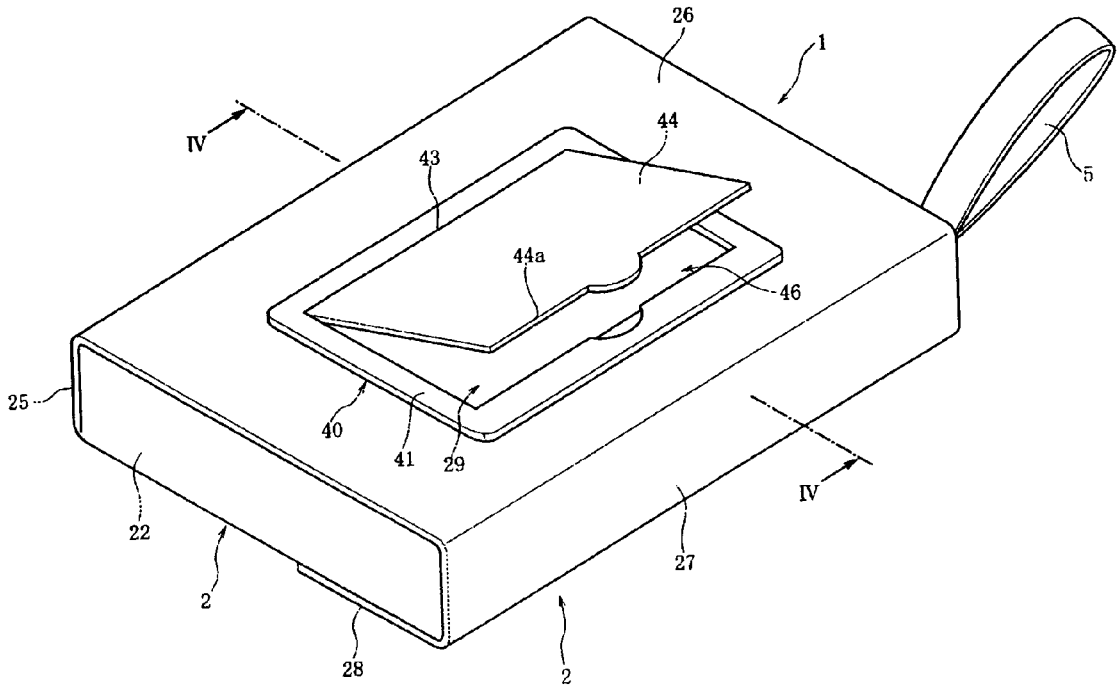
FIG. 1 is a perspective view showing a container according to a first embodiment of the present invention.
Figure 2:
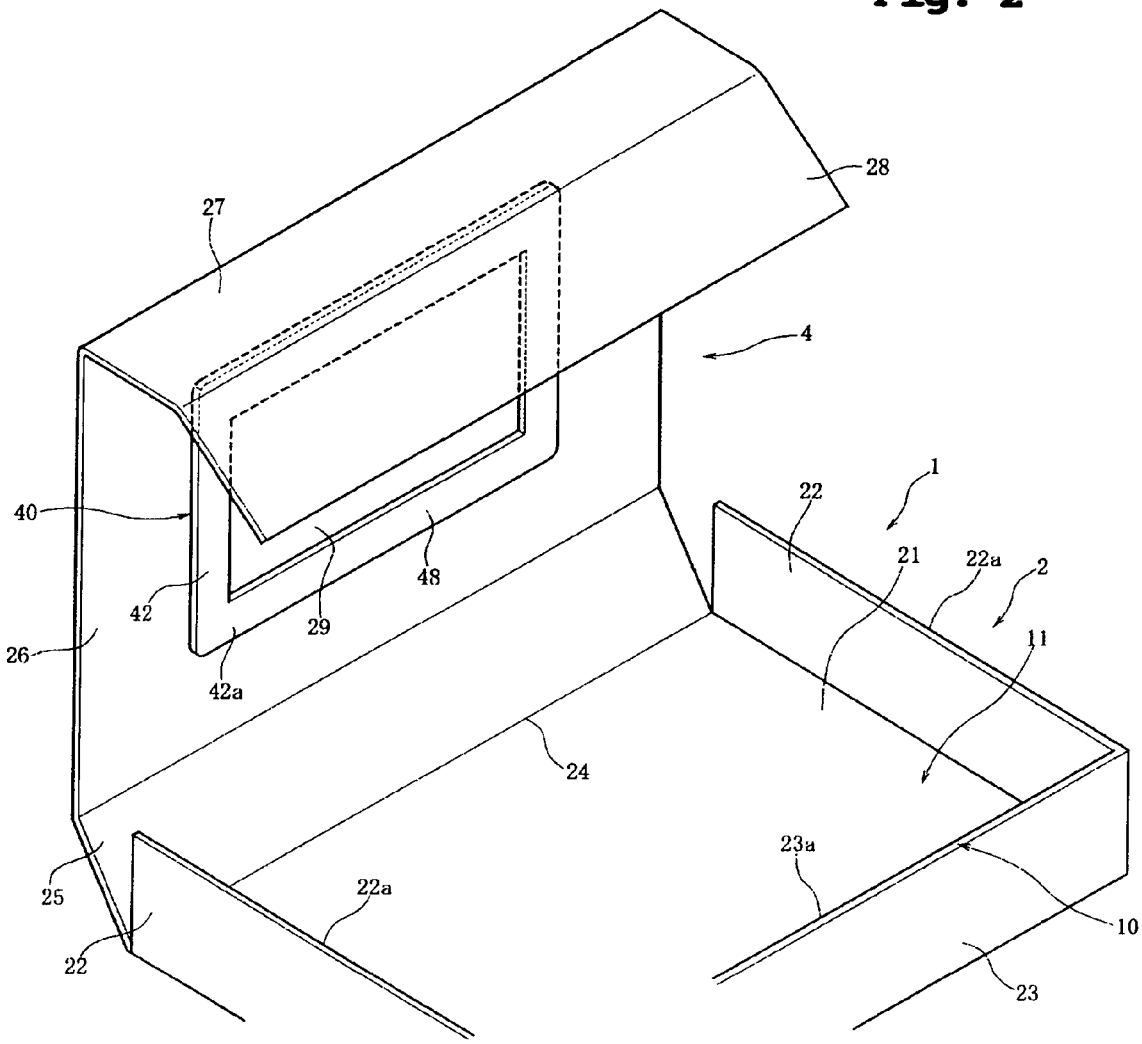
FIG. 2 is a perspective view showing a state where a top part of the container is opened to form a storage opening.
Figure 3:
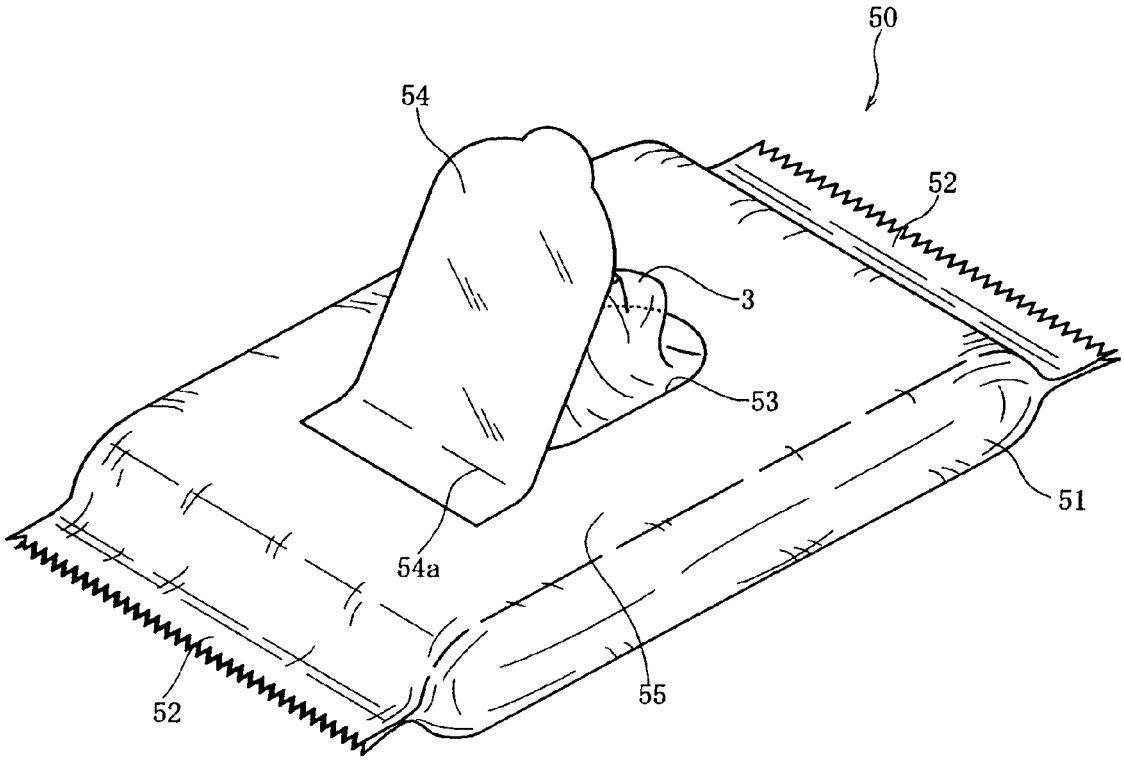
FIG. 3 is a perspective view showing a package to be housed in the container.

FIG. 1 is a perspective view showing a container 1 according to a first embodiment of the present invention; FIG. 2 is a perspective view showing a state where a top part of the container 1 is opened to form a storage opening 10; FIG. 3 is a perspective view showing a package 50 to be housed in the container 1; and FIG. 4 is a sectional view taken along line IV-IV and showing a state where the package 50 is housed in the container 1 of FIG. 1.

As shown in FIGS. 1 and 2, the container 1 has a case 2 which takes the shape of a box when the package 50 is housed therein. At least a part of the case 2 is made of a flexible sheet.

The case according to the invention is different from conventional cubic cases that are injection molded of synthetic resin materials to be rigid as a whole. The flexible sheet may be, for example, a synthetic resin sheet, a nonwoven fabric, a paper material, a metal foil, or composite materials (laminates) thereof. In the invention, the whole case may be made of the flexible sheet. In an alternative, a part of the case may be made of a rigid plastic sheet and the other parts may be made of the flexible sheet. In another alternative, main faces of the box shape may be made of separate rigid plastic sheets and these plastic sheets may be connected to each other through the flexible sheet. Therefore, the case according to the invention, which takes the shape of a box when the package is housed therein, is allowed to be deformed when the package is removed therefrom. For example, the case may be flattened, bent or folded.

Figure 4:
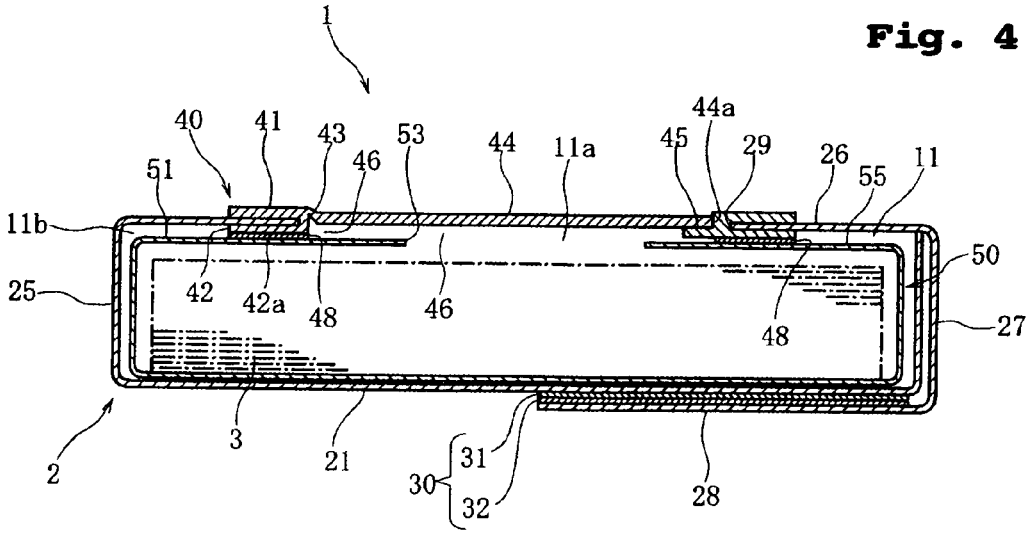
FIG. 4 is a sectional view taken along line IV-IV and showing a state where the package is housed in the container of FIG. 1.

As shown in FIGS. 1, 2 and 4, the case 2 has a rectangular bottom part 21, a pair of end parts 22, 22 rising from short sides of the bottom part 21 roughly at right angles, and a rear side part 23 rising from one long side of the bottom part 21. From the other long side 24 of the bottom part 21, a front side part 25 is extended continuously, and then, a top part 26 leads from the front side part 25, an overlap part 27 leads from the top part 26, and a fixation part 28 leads from the overlap part 27. In the case 2 according to the present embodiment, an openable part 4 is comprised of the front side part 25, the top part 26, the overlap part 27 and the fixation part 28.

All the parts of the case 2 are made of the flexible sheet so as to be freely deformable as a whole, as well as to be foldable into a flat. If desired, the bottom part 21, the end parts 22, 22, the rear side part 23 and the top part 26 may be reinforced with slightly rigid cardboards or slightly rigid plastic sheets.

As shown in FIG. 2, a storage opening 10 defined by upper edges 22*a*, 22*a* of the end parts 22, 22 and an upper edge 23*a* of the rear side part 23 appears in the case 2 when the openable part 4 (the front side part 25, the top part 26, the overlap part 27 and the fixation part 28) is pulled up with the long side 24 functioning as a hinge.

On the other hand, when the top part 26 faces the bottom part 21 and the overlap part 27 and the fixation part 28 are laid on the outer surface of the rear side part 23 and the outer surface of the bottom part 21, respectively, the case 2 takes the shape of a box, as shown in FIGS. 1 and 4. In this box shape, the case 2 defines therein a storage space 11 with the storage opening 10 closed by the top part 26. The storage space 11 is generally in the shape of a rectangular parallelepiped.

Between the outer surface of the bottom part 21 and the inner surface of the fixation part 28, as shown in FIG. 4, there is disposed a hook-and-loop (Velcro) fastener 30 as fixation means. The hook-and-loop fastener 30 is composed of a first sheet 31 secured on the outer surface of the bottom part 21 and a second sheet 32 secured on the inner surface of the fixation part 28. For example, the first sheet 31 may be provided with a large number of unciform or hook-like engaging projections, while the second sheet 32 may be provided with a large number of loops to which the engaging projections can be engaged.

Since the fastener 30 is very easy to use, the case 2 can easily be changed from the opened state of FIG. 2 to the unopened state of FIGS. 1 and 4 and vice versa.

As shown in FIGS. 2 and 4, the top part 26 of the case 2 has a window 29. The window 29 is a generally rectangular opening and has a sufficiently larger open area than a dispensing opening 53 of a package 50 (which will be described later in detail with reference to FIG. 3).

On the top part 26 is mounted a frame 40 which extends all along the periphery of the window 29. The frame 40 is a rigid one that is injection molded of a resin such as polypropylene or polyethylene to integrally form outer and inner panels 41 and 42. In the top part 26, the outer panel 41 is located on the outer surface of the flexible sheet to extend all along the periphery of the window 29, while the inner panel 42 is located on the inner surface of the flexible sheet to extend all along the periphery of the window 29 as well.

The outer panel 41 is integrally formed with a lid 44. The lid 44 is rigid, but connected to an inner edge of one long-side strip of the outer panel 41 through a thin hinge part 43. Thus, the lid 44 is enabled to be turned about the hinge part 43. In an inner edge of the other long-side strip of the outer panel 41 is formed a step 45, as shown in FIG. 4. An opening 46 defined by the frame 40 can be closed with the lid 44 by engaging a leading end 44*a* of the lid 44 to the step 45. When the lid 44 is in a closed position, therefore, the window 29 formed in the case 2 can also be closed, as shown in FIG. 4.

As shown in FIG. 4, the inner panel 42 of the frame 40 provides an inner wall surface 42*a* which is flat and directed toward the storage space 11. On the inner wall surface 42*a* is disposed a pressure-sensitive adhesive layer 48 as close contact means. The pressure-sensitive adhesive layer 48 is rubber-based or acrylic and its adhesion force does not decrease significantly even when the pressure-sensitive adhesive layer 48 is adhered to and removed from a packaging material of the package 50 of FIG. 3 over and over again. Before the first-time use of the container 1, the pressure-sensitive adhesive layer 48 is covered with and protected by a release sheet (not shown). The pressure-sensitive adhesive layer 48 being close contact means is formed to extend continuously all along the periphery of the window 29.

As shown in FIG. 1, the container 1 has a strap 5 extending outward from one end part 22 of the case 2. The strap 5 is made of the same flexible sheet as used for the case 2. The strap 5 is in the form of a loop so as to enable users (e.g., infants) to easily carry around the container 1 by holding the strap 5.

FIG. 3 shows the package 50 to be housed in the container 1. This package 50 is a conventional package formed by housing a stack of a plurality of wet sheets 3 in a bag 51 made of a flexible packaging material. The packaging material may be a resin film made of polypropylene or polyethylene or a laminated sheet of the resin film and a metal foil. The bag 51 is formed such that the packaging material is formed into a cylinder with a longitudinal seal (not shown) and then horizontal seals 52, 52 are formed on longitudinally opposite ends of the cylinder.

On its top part 55, the bag 51 has an elliptical dispensing opening 53 through which the wet sheets 3 can be taken out. Before opening the package 50, the dispensing opening 53 is kept closed with a lid seal 54 adhered to the top part 55 of the bag 51 through a pressure-sensitive adhesive layer. The wet sheets 3 are nonwoven fabrics impregnated with a chemical containing a cleansing ingredient.

How to use the container 1 will be described hereinbelow.

When housing the package 50 in the container 1, the engagement between the fixation part 28 and the bottom part 21 due to the fastener 30 is released to open the openable part 4 (the front side part 25, the top part 26, the overlap part 27 and the fixation part 28) and expose the storage opening 10, as shown in FIG. 2. In the package 50 of FIG. 3, on the other hand, the lid seal 54 adhered to the top part 55 is pulled away to expose the dispensing opening 53. At this time, the lid seal 54 may be entirely peeled off or may be peeled off halfway and cut away at a location indicated by 54*a* in FIG. 3.

Then, the package 50 is put in the storage space 11 of the container 1, which is in the opened state shown in FIG. 2. Here, the release sheet adhered to the inner panel 42 of the frame 40 is peeled off to expose the pressure-sensitive adhesive layer 48 on the inner wall surface 42*a*. Thereafter, the openable part 4 is closed and the fixation part 28 is fixed to the bottom part 21 through the fastener 30, as shown in FIGS. 1 and 4. At this time, the dispensing opening 53 formed in the package 50 is positioned to face the window 29 of the container 1 so that the inner wall surface 42*a* of the frame 40 faces the package 50 around the dispensing opening 53.

By pressing the top part 26 of the container 1 against the package 50, the whole inner wall surface 42*a* of the frame 40 can be adhered to the bag 51 of the package 50 through the pressure-sensitive adhesive layer 48. Alternatively, the adhesion of the top part 55 of the package 50 to the inner wall surface 42*a* of the frame 40 through the pressure-sensitive adhesive layer 48 may be performed with the openable part 4 being kept opened as shown in FIG. 2. That is, the package 50 may be adhered to the frame 40 before it is housed in the storage space 11 and the container 1 is closed as shown in FIGS. 1 and 4.

When the package 50 is housed in the container 1, the inner wall surface 42*a* of the frame 40 is fixed to the package 50 around the dispensing opening 53 through the pressure-sensitive adhesive layer 48, as shown in FIG. 4. Hence, a space 11*a* surrounded by the pressure-sensitive adhesive layer 48 (or the opening 46 defined by the frame 40) communicates with the inside of the package 50 through the dispensing opening 53. Here, the space 11*a* is isolated from a space 11*b*, which is the rest of the clearance formed between the outer surface of the package 50 and the inner surface of the case 2, due to the pressure-sensitive adhesive layer 48. By closing the lid 44, the space 11*a* surrounded by the pressure-sensitive adhesive layer 48 can also be isolated from the outside of the container 1. Therefore, there is only a small space left inside the container 1 to permit evaporation of water inside the package 50, which contributes to enhancing the effect of keeping the wet sheets 3 from drying out.

In addition, since the whole package 50 is enclosed and supported by the case 2 and the frame 40, the package 1 being carried around is effectively prevented from being subjected to a force to tear the frame 40 from the package 50 or a force to slide the frame 40 on the package 50, so that the fixation due to the pressure-sensitive adhesive layer 48 can be certainly maintained.

By pulling up the lid 44 with the hinge part 43 functioning as a pivot, as shown in FIG. 1, the dispensing opening 53 of the package 50 can be exposed within the opening 46 defined by the frame 40. Thus, the wet sheets 3 can be easily taken out through the dispensing opening 53. After removal of the wet tissues 3, the space 11*a* communicating with the inside of the package 50 can be isolated only by closing the lid 44.

Figure 5:
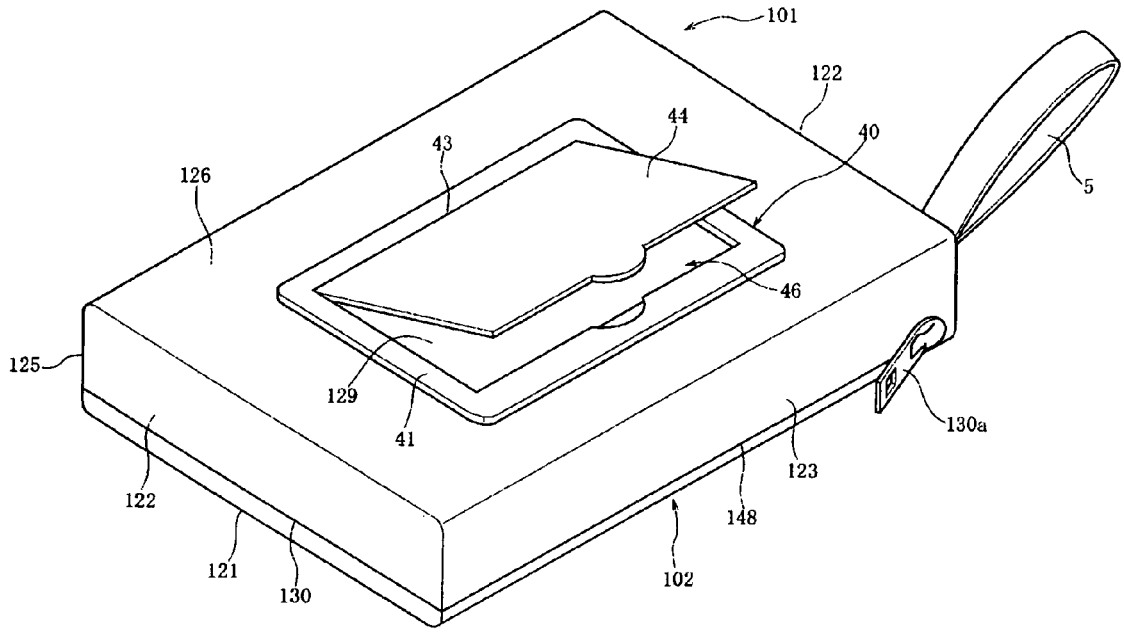
FIG. 5 is a perspective view showing a container according to a second embodiment of the present invention.

FIG. 5 is a perspective view showing a container 101 according to a second embodiment of the present invention. In the container 101, the frame 40 and the strap 5 are not changed from those used in the first embodiment, but a case 102 is of a different construction from the case 2 according to the first embodiment.

In FIG. 5, the case 102 is in the shape of a box and has a top part 126 with a window 129, a bottom part 121, a rear side part 123, a front side part 125, and two end parts 122. 122. The frame 40 is mounted on the top part 126. In this embodiment, the openable part is predominantly comprised of the bottom part 121, and a zipper 130 is provided as fixation means to go around the case 102 from the rear side part 123, through one end part 122 and the front side part 125, to the other end part 122.

By moving an opening tab 130*a* along the zipper 130, almost the whole bottom part 121 can be separated downward except for only a small part thereof In this opened state, the package 50 is put in the storage space 11 from below and then the top part 55 of the package 50 is adhered to the inner wall surface 42*a* of the frame 40 through the pressure-sensitive adhesive layer 48.

Alternatively, the zipper 130 may be provided to enable almost the whole top part 126 to be separated upward from the other parts.

It should be noted that the fixation means is not limited to the hook-and-loop fastener 30 of the first embodiment or the zipper 130 of the second embodiment, but may be, for example, a hook or button through which the bottom part 21 and the fixation part 28 of the case 2 can be fastened together. In the present invention, since the container can be kept in close contact with the package around the dispensing opening through the close contact means (e.g., pressure sensitive adhesive layer 48), it is not required to seal the case with complex fixation means. Thus, a wide variety of simple fixation means may be employed as set forth above.

Figure 6:
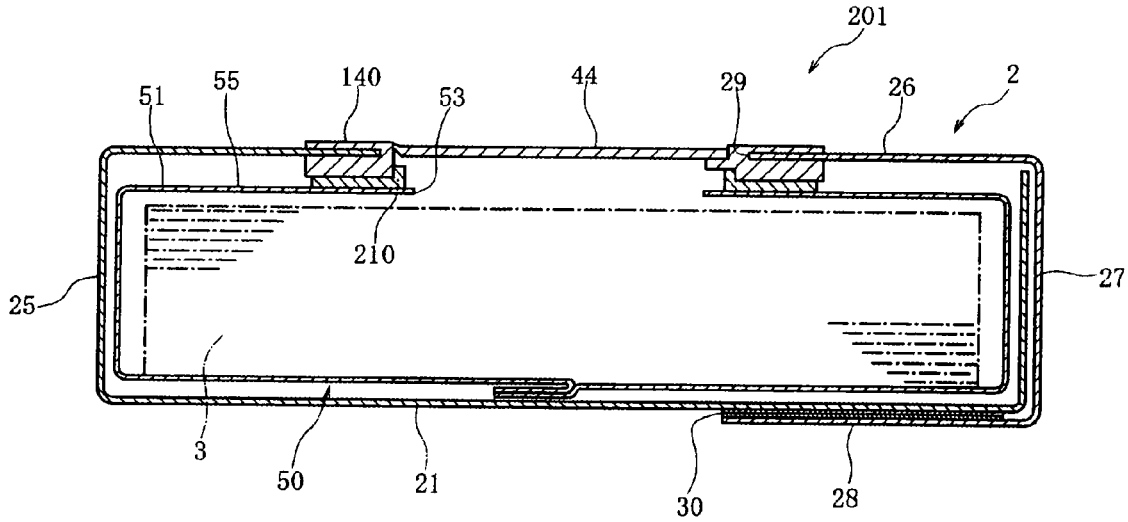
FIG. 6 is a sectional view showing a container according to a third embodiment of the present invention.

FIG. 6 is a sectional view showing a container 201 according to a third embodiment of the present invention. In this container 201, the case 2 is not changed from that used in the first embodiment. All along the periphery of the window 29, a frame 140 is mounted on the top part 26 of the case 2. The frame 140 is integrally formed with lid 44.

In this embodiment, a fitting frame 210 is employed as close contact means for keeping the container 201 in close contact with the package 50 around the dispensing opening 53. The fitting frame 210 is secured on the bag 51 of the package 50 around the dispensing opening 53 through a pressure-sensitive adhesive. When putting the package 50 in the case 2, the space above the dispensing opening 53 can be isolated with the fitting frame 210 brought into close contact with and fitted to the frame 140 around the dispensing opening 53.

When changing the package 50 housed in the container 201, the fitting frame 210 is removed from the used package 50 and mounted on a new package 50 to be housed in the case 2.

Although the present invention has been illustrated and described with respect to exemplary embodiments thereof, it should be understood by those skilled in the art that the foregoing and various other changes, omission and additions may be made therein and thereto, without departing from the spirit and scope of the present invention. Therefore, the present invention should not be understood as limited to the specific embodiments set out above but to include all possible embodiments which can be embodied within a scope encompassed and equivalent thereof with respect to the feature set out in the appended claims.

What is the claimed is:

1. A container for a package formed by housing wet sheets in a bag which is made of a flexible packaging material and has a dispensing opening, the container comprising:

a case having at least a part made of a flexible sheet to define therein a storage space for housing the package, a window for facing the dispensing opening of the package, and an openable part which is integral with the case but operable to separate away from other parts of the case to form a storage opening enabling the package to be inserted into the storage space;

fixation means for keeping the openable part in an unopened position to close the storage opening;

a frame secured to the case all along the periphery of the window, the frame having an integrally-formed outer panel and an integrally-formed inner panel which are secured to respective outer and inner surfaces of the flexible sheet along a perimeter of the window;

a lid for closing an opening defined by the frame and closing the window; and close contact means applied to the inner surface of the inner panel for keeping an inner surface of the container in close contact with the bag around the dispensing opening.

2. A container according to claim 1, wherein the case has a top part with the window and a bottom part on an opposite side from the top part, and the openable part includes one of the top part or the bottom part.

3. A container according to claim 1, wherein the fixation means is a hook-and-loop fastener for engaging confronting surfaces of the flexible sheet of the case.

4. A container according to claim 1, wherein the fixation means is a zipper.

5. A container according to claim 1, wherein the close contact means enables the close contact all along the periphery of the window with the dispensing opening positioned within the window.

6. A container according to claim 1, wherein the close contact means is a pressure-sensitive adhesive layer.

7. A container according to claim 6, wherein the frame has an inner wall surface which is flat and located inside the case for facing the package and the pressure-sensitive adhesive layer is disposed on the inner wall surface.

8. A container according to claim 1, further comprising:

the package formed by housing wet sheets in a bag which is made of the flexible packaging material, the package further including a fitting frame which is allowed to be mounted on the package around the dispensing opening and to be fitted to the frame secured to the case.

9. A container according to claim 1, wherein: the openable part further comprises:

a front side part hingedly connected to a bottom part of the container, a top part hingedly connected to a top edge of the front side part, an overlap part hingedly connected to a back side of the top part, and a fixation part hingedly connected to the overlap part, the fixation part configured to be operable with the fixation means to close the storage opening, the window being provided in the top part, wherein:

when the openable part is pulled up for opening, a storage space is defined by the bottom part, two side parts and a rear part of the container.

10. A container for a package, comprising:

a case having (a) a flexible sheet to define a storage space for housing the package, which has a dispensing opening, (b) a window for facing the dispensing opening of the package, and (c) an openable part which is integral with the case but operable to separate from other parts of the case to form a storage opening for enabling the package to be inserted into the storage space; and fixation means for keeping the openable part closed a frame secured to the periphery of the window, the frame having an integrally-formed outer panel and an integrally-formed inner panel which are secured to respective outer and inner surfaces of the flexible sheet along a perimeter of the window;

a lid for closing an opening defined by the frame; and close contact means applied to the inner surface of the inner panel for keeping an inner surface of the container in close contact with a bag to be contained in the container.

11. A container according to claim 10, wherein the case comprises: a top part with the window; and a bottom part opposite to the top part, wherein the openable part includes either the top part or the bottom part.

12. A container according to claim 10, wherein the fixation means is a hook-and-loop fastener for engaging confronting surfaces of the flexible sheet of the case.

13. A container according to claim 10, wherein the fixation means is a zipper.

14. A container according to claim 10, wherein the close contact means is adapted to have close contact all along the periphery of the window with the dispensing opening positioned within the window.

15. A container according to claim 10, wherein the close contact means is a pressure-sensitive adhesive layer.

16. A container according to claim 15, wherein the frame has an inner wall surface which is flat and located inside the case for facing the package and the pressure-sensitive adhesive layer is disposed on the inner wall surface.

17. A container according to claim 10, further comprising:

the package, the package further including a fitting frame mounted on the package around a dispensing opening to fit to the frame secured to the case.

18. A container according to claim 10, wherein: the openable part further comprises:

a front side part hingedly connected to a bottom part of the container, a top part hingedly connected to a top edge of the front side part, an overlap part hingedly connected to a back side of the top part, and a fixation part hingedly connected to the overlap part, the fixation part configured to be operable with the fixation means to close the storage opening, the window being provided in the top part, wherein:

when the openable part is pulled up for opening, a storage space is defined by the bottom part, two side parts and a rear part of the container.

* * * * *